US010738573B2

(12) United States Patent
Yin et al.

(10) Patent No.: US 10,738,573 B2
(45) Date of Patent: Aug. 11, 2020

(54) FLOW-INDUCED EROSION-CORROSION RESISTANCE IN DOWNHOLE FLUID FLOW CONTROL SYSTEMS

(71) Applicant: HALLIBURTON ENERGY SERVICES, INC., Houston, TX (US)

(72) Inventors: Weiqi Yin, Plano, TX (US); Frederic Nicolas Felten, Corinth, TX (US); Georgina Corona Cortes, Plano, TX (US); Caleb Thomas Warren, Richardson, TX (US); Bryon David Mullen, Carrollton, TX (US); Richard Hancock Merrill, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/736,508

(22) PCT Filed: Jul. 8, 2016

(86) PCT No.: PCT/US2016/041553

§ 371 (c)(1),
(2) Date: Dec. 14, 2017

(87) PCT Pub. No.: WO2018/009220

PCT Pub. Date: Jan. 11, 2018

(65) Prior Publication Data

US 2019/0112903 A1 Apr. 18, 2019

(51) Int. Cl.

| | |
|---|---|
| ***E21B 43/12*** | (2006.01) |
| ***E21B 41/02*** | (2006.01) |
| *E21B 37/06* | (2006.01) |

(52) U.S. Cl.

CPC ..... *E21B 43/121* (2013.01); *E21B 41/02* (2013.01); *E21B 43/12* (2013.01); *E21B 37/06* (2013.01)

(58) Field of Classification Search
None
See application file for complete search history.

(56) References Cited

U.S. PATENT DOCUMENTS 4,372,378 A 2/1983 Powers, Jr.
5,896,928 A * 4/1999 Coon ..... E21B 43/12 166/373

(Continued)

FOREIGN PATENT DOCUMENTS

EP 2669466 A2 12/2013
WO WO 2015/122907 A1 8/2015

OTHER PUBLICATIONS

International Search Report and The Written Opinion of the International Search Authority, or the Declaration, dated Apr. 10, 2017, PCT/US2016/041553, 15 pages, ISA/KR.

*Primary Examiner* — Shane Bomar
(74) *Attorney, Agent, or Firm* — Haynes and Boone, LLP

(57) ABSTRACT

Fluid flow control systems are configured to resist erosion-corrosion and minimize wall shear stress during injection or production. A fluid flow control system includes a base pipe with an internal passageway. A housing is positioned around the base pipe to define a fluid flow path between the filter component and the internal passageway. A flow control component is positioned within the fluid flow path in order to control fluid flow. A flow-induced erosion resistance component, which may take a variety of forms, is positioned within the fluid flow path to reduce and/or eliminate wall shear stress along the base pipe. As a result, erosion-corrosion of the bases pipe is reduced and/or eliminated altogether.

22 Claims, 12 Drawing Sheets

(56) References Cited

U.S. PATENT DOCUMENTS

| | | | | |
|---|---|---|---|---|
| 6,494,265 | B2 * | 12/2002 | Wilson | E21B 34/06 166/332.1 |
| 7,786,414 | B2 | 8/2010 | Schilling et al. | |
| 7,789,145 | B2 | 9/2010 | Patel | |
| 2007/0246210 | A1 * | 10/2007 | Richards | E21B 43/08 166/56 |
| 2007/0246212 | A1 * | 10/2007 | Richards | E21B 43/121 166/227 |
| 2009/0008078 | A1 | 1/2009 | Patel | |
| 2010/0200233 | A1 | 8/2010 | Yeh et al. | |
| 2014/0262322 | A1 | 9/2014 | Yeh et al. | |
| 2015/0027726 | A1 | 1/2015 | Bruce et al. | |
| 2015/0292300 | A1 | 10/2015 | Franklin et al. | |
| 2015/0376990 | A1 * | 12/2015 | Bonner | E21B 43/08 166/373 |
| 2016/0326850 | A1 * | 11/2016 | Hailey, Jr. | E21B 43/04 |
| 2017/0130566 | A1 * | 5/2017 | McNamee | E21B 34/06 |

* cited by examiner

FLOW-INDUCED EROSION-CORROSION RESISTANCE IN DOWNHOLE FLUID FLOW CONTROL SYSTEMS

FIELD OF THE DISCLOSURE

The present disclosure relates generally to subterranean well operations and, more specifically, to downhole fluid flow control systems having enhanced erosion and corrosion resistance, as well as base pipe wall shear stress minimization capabilities.

BACKGROUND

During completion of wells that traverse a hydrocarbon bearing formation, production tubing and completion equipment is installed in the well to enable safe and efficient production of formation fluids. For example, to prevent the production of particulate material from an unconsolidated or loosely consolidated subterranean formation, certain completions include one or more sand control screen assemblies positioned proximate the desired production interval or intervals. In other completions, to control the flowrate of production fluids into the production tubing, it is common practice to install one or more inflow control devices ("ICDs") along the tubing string.

ICDs are a proven technology for overall flux balance. A conventional ICD, due to its nature of creating flow restrictions, has certain regions with higher velocities and base pipe wall shear within its fluid flow path. In a scenario where operators need to perform acid stimulation, the associated corrosive environment, along with the high wall shear induced by the nature of the ICD, can lead to mechanical failure of the device. Mechanical failure is caused by the erosion of the oxide layer generated by the corrosive chemicals. As the fluid flows past the base pipe at elevated rates, the resultant wall shear erodes the corrosive layer, referred to as "flow-induced erosion." In many cases, the flow-induced erosion will continue until mechanical failure of the device. Expensive corrective operations are then necessary to repair the completion assembly.

DESCRIPTION OF ILLUSTRATIVE EMBODIMENTS

Illustrative embodiments and related methods of the present disclosure are described below as they might be employed in erosion-corrosion resistant fluid flow control. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

As described herein, illustrative embodiments of the present disclosure are directed to various fluid flow control systems configured to resist erosion-corrosion and minimize wall shear stress during injection or production. In a generalized embodiment, a fluid flow control system includes a base pipe with an internal passageway. A housing is positioned around the base pipe to define a fluid flow path between a filter component and the internal passageway. A flow control component is positioned within the fluid flow path in order to control fluid flow. A flow-induced erosion resistance component is positioned within the fluid flow path to reduce and/or eliminate wall shear stress along the base pipe. The flow-induced erosion resistance component may take a variety of forms, as described below. As a result of the flow-induced erosion resistance component, erosion-corrosion of the bases pipe is reduced and/or eliminated altogether.

Figure 1:
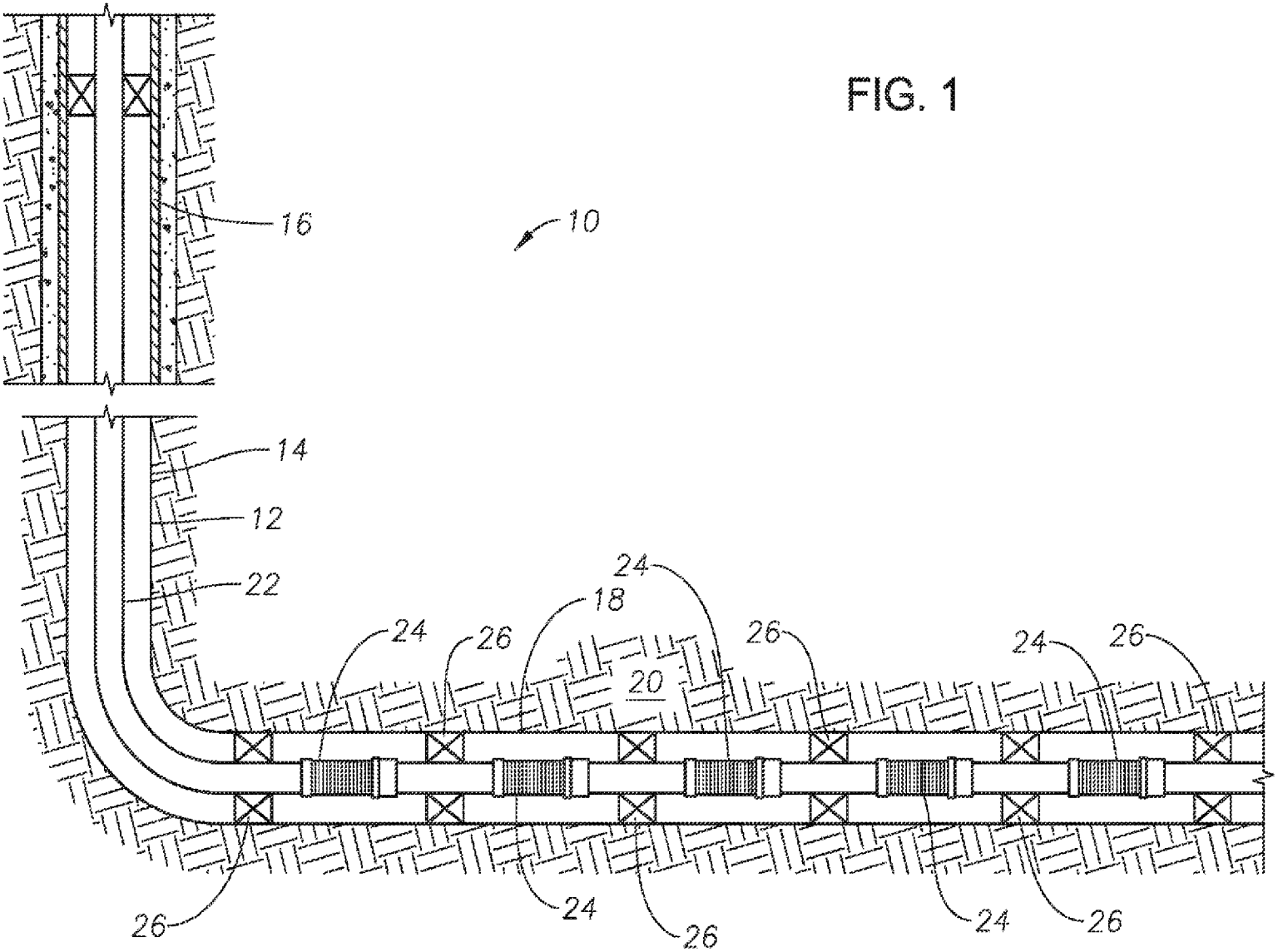
FIG. 1 is a well system that may employ the principles of the present disclosure, according to one or more illustrative embodiments.

Referring initially to FIG. 1, therein is depicted a well system 10 including a plurality of downhole fluid flow control systems positioned in flow control screens, according to certain illustrative embodiments of the present disclosure. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals.

In the illustrated embodiment, flow control screens 24 serve the function of filtering particulate matter out of the production fluid stream. Each flow control screen 24 also has a flow control section that is operable to control fluid flow therethrough. For example, the flow control sections may be operable to control flow of a production fluid stream during the production phase of well operations. Alternatively or additionally, the flow control sections may be operable to control the flow of an injection fluid stream during a treatment phase of well operations. As explained in greater detail below, the flow control sections are operable to minimize and/or eliminate erosion-corrosion, and subsequent mechanical failure, over the life of the well to thereby maximize production of a desired fluid, such as oil.

Even though FIG. 1 depicts the flow control systems of the present disclosure in an open hole environment, it should be understood by those ordinarily skilled in the art having the benefit of this disclosure that it is equally well suited for use in cased wells. Also, even though FIG. 1 depicts one flow control screen in each production interval, it should be understood by those skilled persons that any number of flow control systems may be deployed within a production interval or within a completion interval that does not include production intervals without departing from the principles of the present disclosure. In addition, even though FIG. 1 depicts the flow control systems in a horizontal section of the wellbore, it should be understood by those skilled persons that it is well suited for use in wells having other directional configurations including vertical wells, deviated wells, slanted wells, multilateral wells and the like. Moreover, even though FIG. 1 depicts the flow control components in a flow control section of a flow control screen, it should be understood by those skilled in the art that the flow control components of the present invention need not be associated with a flow control screen or be part of a completion string, for example, the flow control components may be operably disposed within a drill string for drill stem testing.

Figure 2A:
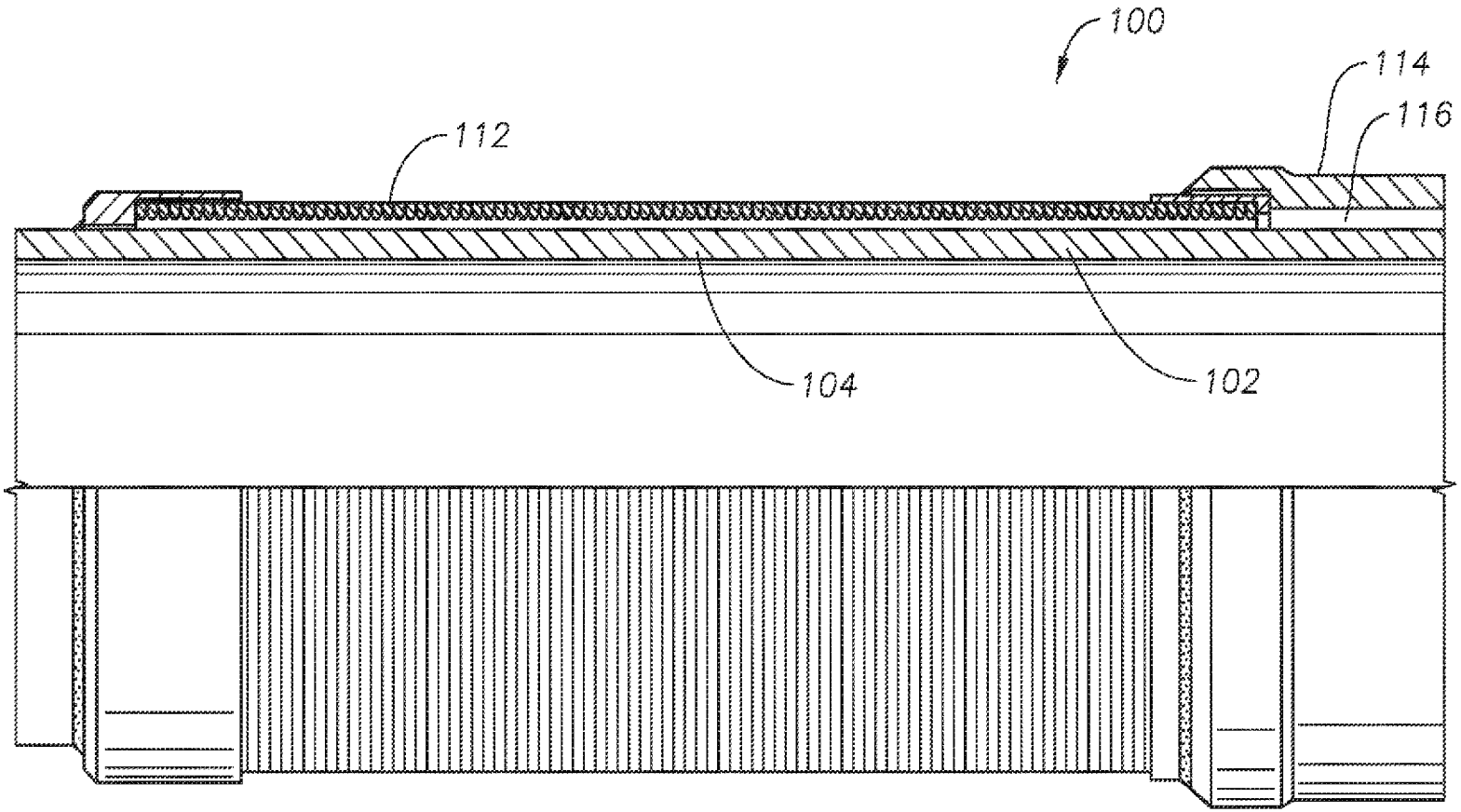
FIGS. 2A-2B depict successive axial sections of a flow control system, according to the certain illustrative embodiments of the present disclosure.
Figure 2B:
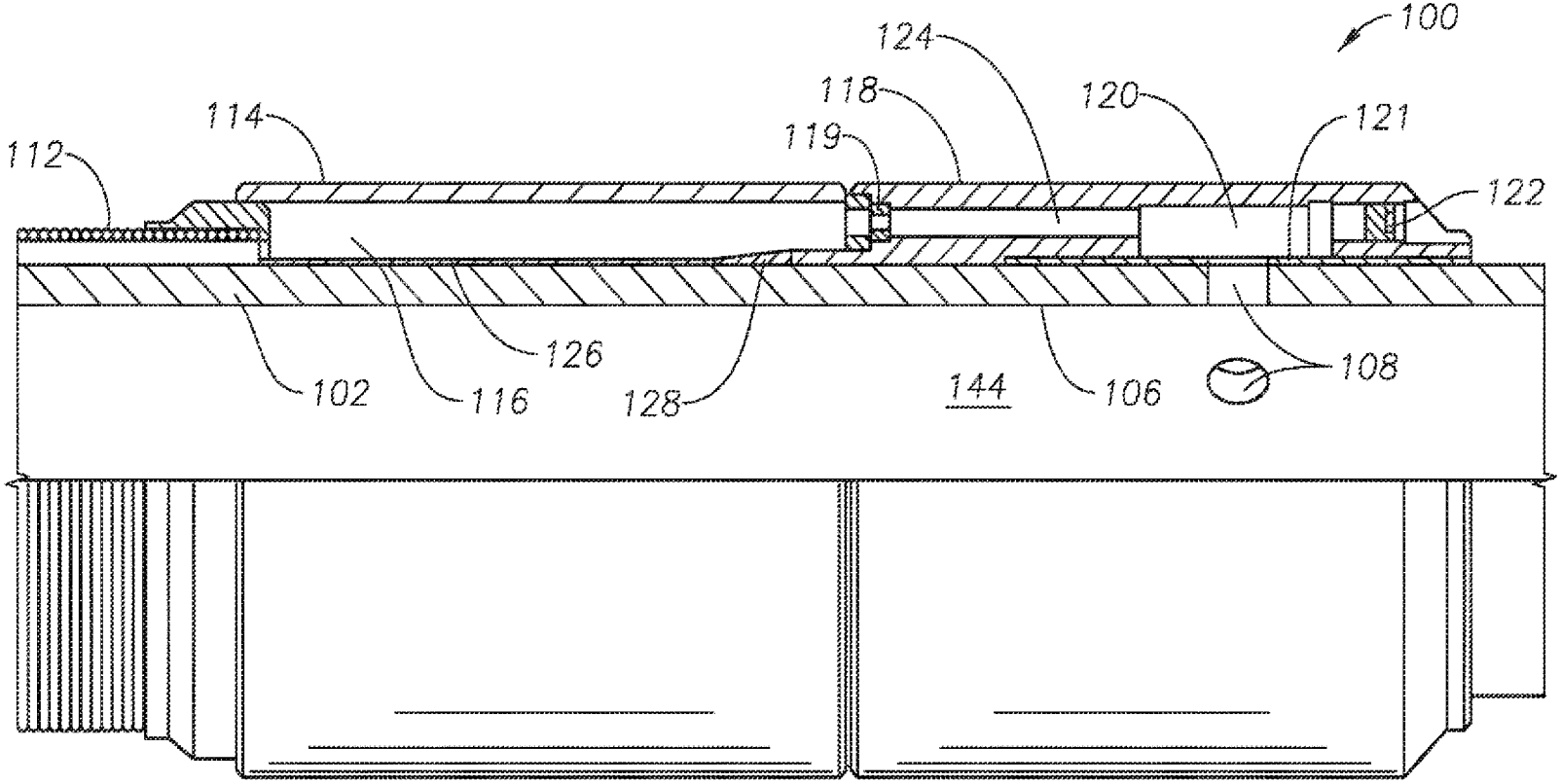

Referring next to FIGS. 2A-2B, therein is depicted successive axial sections of a flow control system 100, according to the certain illustrative embodiments of the present disclosure. Flow control system 100 may be suitably coupled to other similar flow control systems, production packers, locating nipples, production tubulars or other downhole tools to form a completions string as described herein. Flow control system 100 includes a base pipe 102 that has a blank pipe section 104 and a perforated section 106 including a one or more flow ports 108. Positioned around an uphole portion of blank pipe section 104 is a screen assembly element or filter component/medium 112, such as a wire wrap screen a woven wire mesh screen, a, prepacked screen or the like, designed to allow fluids to flow therethrough but prevent particulate matter of a predetermined size from flowing therethrough. It will be understood, however, by those ordinarily skilled in the art that the present disclosure does not need to have a filter medium associated therewith, accordingly, the exact design of the filter component is not critical to the present disclosure.

Positioned downhole of filter component 112 is a screen interface housing 114 that Forms an annulus 116 with base pipe 102. Securably connected to the downhole end of screen interface housing 114 is a flow control component housing 118 that forms an annulus 120 with base pipe 102. Flow control component 119 is housed within housing 118 and may be a variety of choke points, including for example, one or more nozzles that control fluid flow therethrough. At its downhole end, flow control housing 118 contains a plug 122, used to prevent keep fluid from leaking out of flow control housing 118, as well as serve as an access port to service and/or remove nozzles 119. The various connections of the components of flow control system 100 may be made in any suitable fashion including welding, threading and the like, as well as through the use of fasteners such as pins, set screws and the like.

In certain illustrative embodiments, flow control components 119 are circumferentially distributed about base pipe 102 at desired intervals. However, it should be understood that other numbers and arrangements of flow control components 119 may be used. For example, either a greater or lesser number of circumferentially distributed flow control components 119 at uniform or nonuniform intervals may be used. Additionally or alternatively, flow control components 119 may be longitudinally distributed along base pipe 102. Flow control components 119 each have a fluid flow path 124. As will be described in more detail below, housings 114,118 define a fluid flow path around base pipe 102. Annulus 116, flow path 124, and annuls 120 form the fluid flow path between filter component 112 and internal passageway 144 of base pipe 102.

With reference to FIG. 2B, a flow-induced erosion resistance component 126 is positioned within the fluid flow path between filter component 112 and flow control component 119. Flow-induced erosion resistance component 126 may be a variety of components which reduce wall shear stress along base pipe 102. Such components may include, for example, snap rings or sleeves. The components may be comprised of a variety of materials, such as, for example, flexible or rigid members, and may be attached in any suitable way, such as, for example, welding, compression fitting or adhesion. Nevertheless, through use of flow-induced erosion resistance component 126, the erosion corrosion phenomena will be mitigated and/or eliminated, in the illustrated example, flow-induced erosion resistance component 126 is a sleeve member positioned around base pipe 102. The sleeve member may be made of a variety of materials, including, for example, Inconel® nickel-chromium alloy 625, inert plastics, rubber, or some other high-strength material that provides corrosion resistance to the downhole fluids in use. Ultimately, however, flow-induced erosion resistance component 126 is of a higher corrosion resistant material than that of base pipe 102.

In this example, sleeve member 126 extends from filter component 112 to a flow guide 128 of flow control component 119. As shown, flow guide 128 is an angular shaped end piece which provides a smooth transition from sleeve member 126 to flow control component 119, so that unnecessary shear will not be created as fluid flows thereby during production or injection. Moreover, as shown in FIG. 2B, certain illustrative embodiments include a sleeve member 121 extending around the portion of base pipe 102 adjacent openings 108 to protect the covered portion of base pipe 102. Sleeve member 121 may be of the same material as that of sleeve member 126, or it may be another erosion/corrosion resistant material.

Flow control components 119 may be operable to control the flow of fluid in either direction therethrough and may even have directional dependent flow resistance certain embodiments. During the treatment phase of well operations, a treatment fluid may be pumped downhole from the surface in the interior passageway 144 of base pipe 102 (see FIG. 2A-2B). The treatment fluid then enters the flow control components 119 as through annulus 120 and passes through flow path 124, where the desired flow resistance is applied by nozzle 119 to the fluid flow, thus achieving the desired pressure drop and flowrate therethrough. The fluid then travels into annular region 116 between flow-induced erosion resistance component 126 and housing 114 before passing through filter component 112 for injection into the surrounding formation. Due to the presence of flow-induced erosion resistance component 126, base pipe 102 is protected from fluid contract and the associated shear wall stress created by the fluid flow. Thus, erosion-corrosion is reduced and/or eliminated.

Likewise, during the production phase of well operations, fluid flows from the formation into the production tubing through fluid flow control system 100. The production fluid, after being filtered by filter component 112, if present, flows into annulus 116 between flow-induced erosion resistance component 126 and housing 114 before entering the flow control component section. During this time, flow-induced erosion resistance component 126 protects base pipe 102 from wall shear. The fluid is then guided along flow guide 128 and into nozzles 119, where the desired flow resistance is applied to the fluid flow achieving the desired pressure drop and flowrate therethrough. Thereafter, the fluid flows through fluid path 124 and annulus 120. and is discharged through openings 108 to interior passageway 144 of base pipe 102 for production to the surface. Even though a particular flow control components 119 has been depicted and described, those ordinarily skilled in the art will recognize that other flow control components having alternate designs may be used without departing from the principles of the present disclosure including, but not limited to, inflow control devices, fluidic devices, venturi devices, fluid diodes and the like.

Figure 2C:
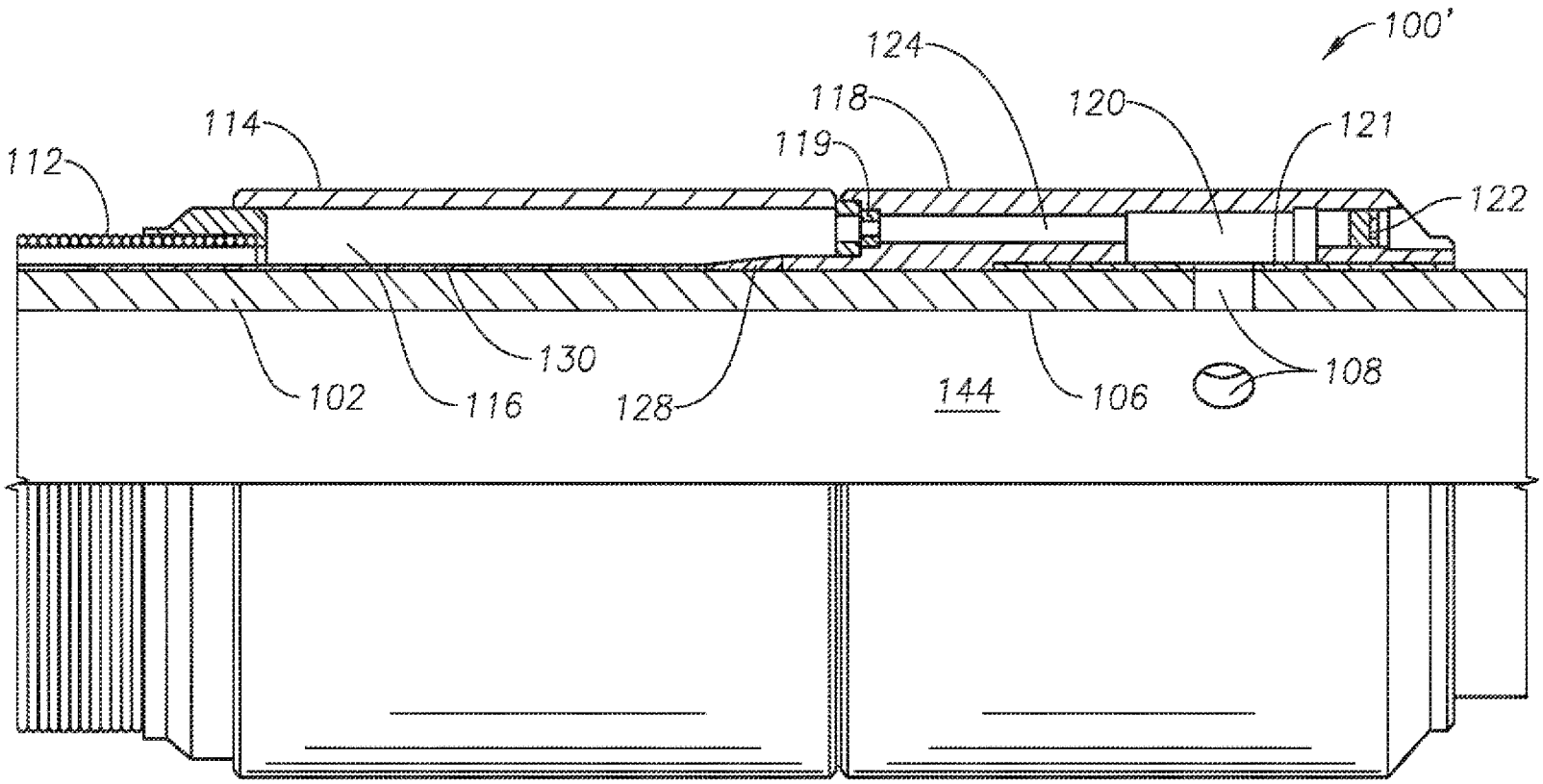
FIGS. 2C-2E are partial views of a flow control system section having sleeve members, according to certain alternative embodiments of the present disclosure.

FIG. 2C is a partial view of a flow control system section, according to certain alternative embodiments of the present disclosure. Flow control system 100' is similar to flow control system 100, as like numerals refer to like elements. However, in FIG. 2C, flow control system 100' includes a flow-induced erosion resistance component 130 which extends to a position underneath filter component 112. Alternative, flow-induced erosion resistance component 130 may extend the length of filter component 112. Nevertheless, as a result, flow-induced erosion resistance component 130 can protect against erosion-corrosion underneath filter component 112 during production or injection operations.

Figure 2D:
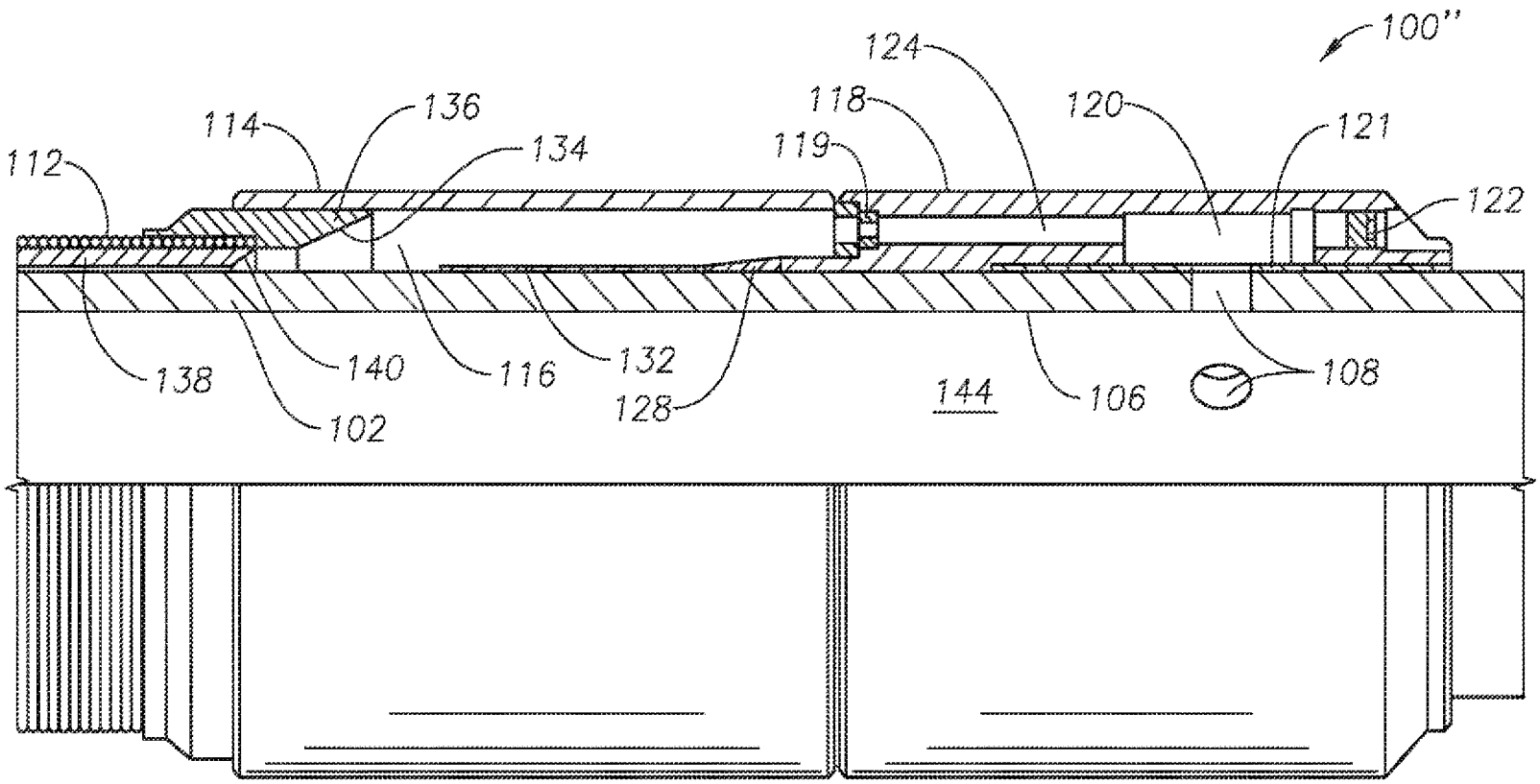

FIG. 2D is a partial view of a flow control system section, according to certain alternative embodiments of the present disclosure. Flow control system 100" is similar to flow control system 100, as like numerals refer to like elements. However, in FIG. 2D, flow control system 100" includes a flow-induced erosion resistance component 132 which extends from flow control component 119 to a position between filter component 112 and flow control component 119. Moreover, in certain illustrative embodiments, the end of screen assembly 138 of filter component 112 nearest component 119 comprises an angular face 140 oriented toward flow control component 119. In addition, the end of interface ring 136 of filter component 112 nearest component 119 also comprises an angular face 134 oriented toward flow control component 119. During injection or production operations, flow-induced erosion resistance component 132 protects the portion of base pipe 102 it covers from erosion-corrosion. In addition, angular faces 134 and 140 further help to reduce the shear stress along annulus 116.

Figure 2E:
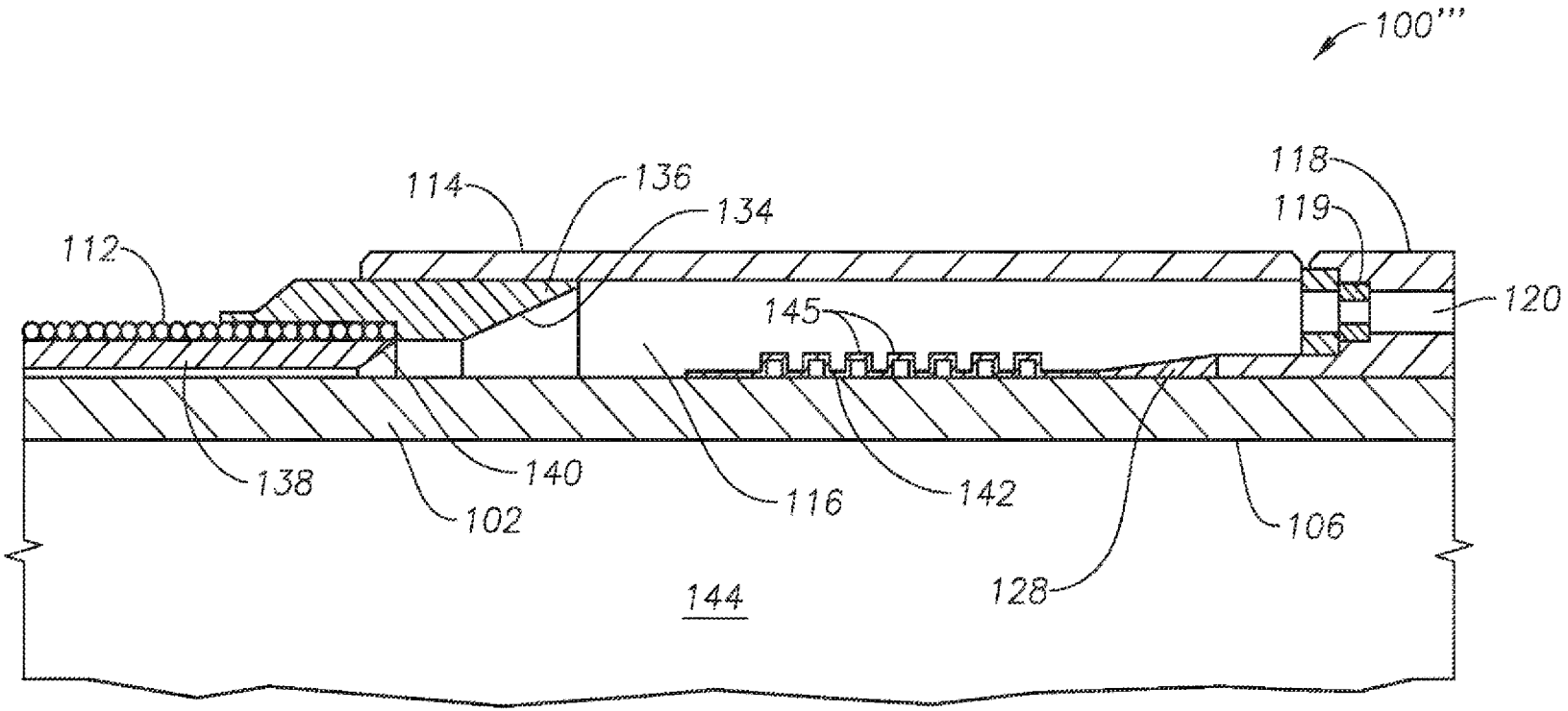

FIG. 2E is a partial view of a flow control system section, according to certain alternative embodiments of the present disclosure. Flow control system 100'" is similar to flow control system 100, as like numerals refer to like elements. However, in FIG. 2E, flow control system 100'" includes a flow-induced erosion resistance component 142 having a plurality of ribs 145 oriented in a direction transverse to the longitudinal axis of base pipe 102. Accordingly, as the fluid flows past flow-induced erosion resistance component 142, ribs 145 dissipates the fluid energy in addition to protecting base pipe 102.

Figure 3A:
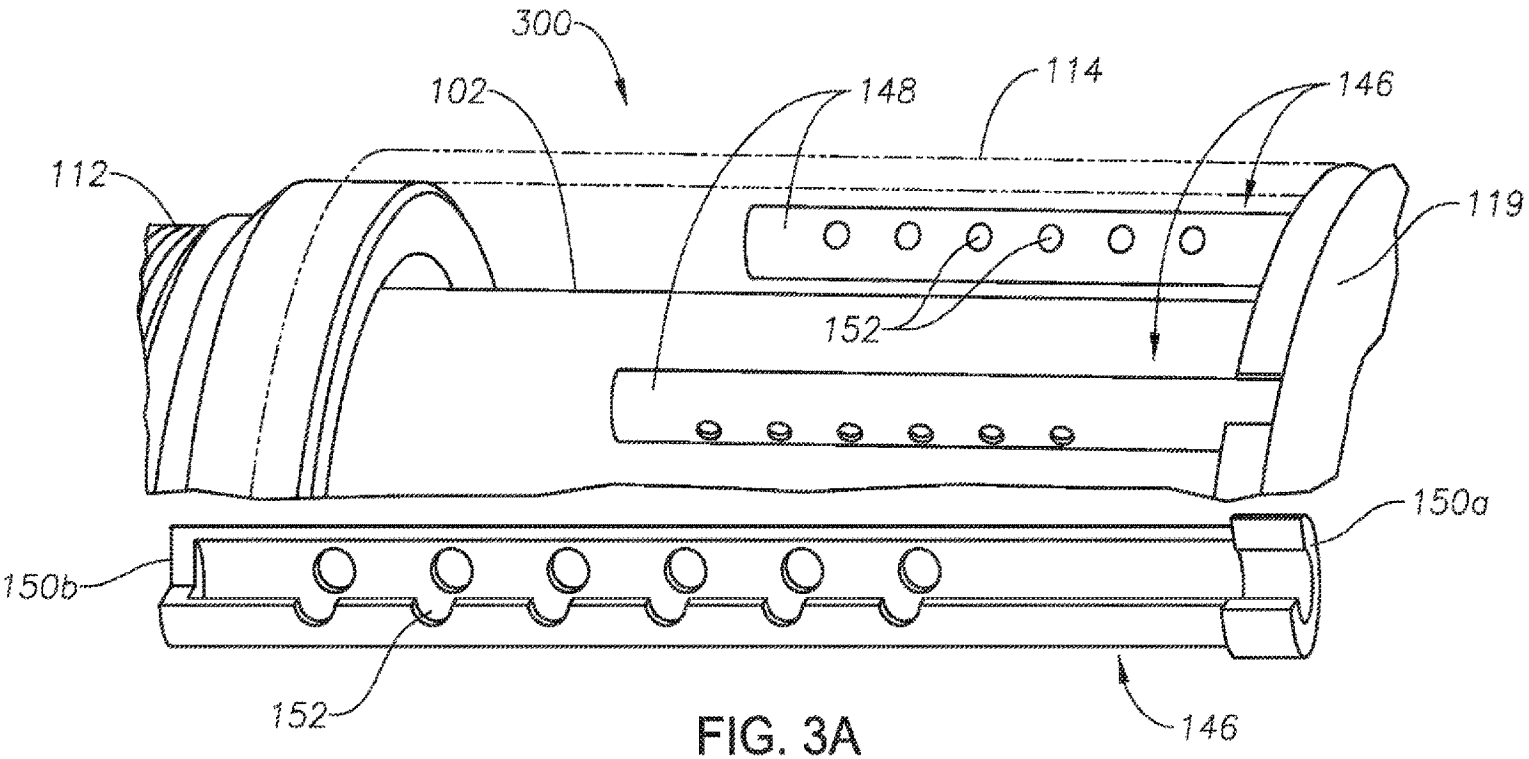
FIG. 3A is a partial view of a flow control system section having deflector tubes, according to certain alternative embodiments of the present disclosure.

FIG. 3A is a partial view of a flow control system section, according to certain alternative embodiments of the present disclosure. Flow control system 300 is similar to flow control system 100, as like numerals refer to like elements. However, in FIG. 3A, flow control system 300 includes one or more deflector tubes 146 connected to flow control component 119 (e.g., nozzles 119). In this example, tubes 146 operate as the flow-induced erosion resistance components. Tubes 146 include a tubular body 148 having a first end 150*a* and a second end 150*b*. End 150*a* is connected to flow control component 119, while second end 150*b* is sealed to prevent fluid flow therethrough. One or more perforations 152 are positioned along tubular body 148.

During injection operations, as fluids flow from internal passageway 144 and into flow control component 119, it enters tubes 146. As the fluid enters tubes 146 under high pressure, it encounters sealed second end 150*b* where it is prevented from flowing therethrough. As a result, the fluid is then forced out of perforations 152 into a direction lateral from the longitudinal axis of base pipe 102. This accomplishes a number of things: first, the energy of the fluid is dissipated. Second, the fluid is diverted from its original direction (parallel to the longitudinal axis of base pipe 102) and to a second direction transverse to the second direction. As a result, any wall shear presented by the flow of the fluid is reduced and/or eliminated, thus alleviating erosion-corrosion along base pipe 102. The same phenomena occurs in the production direction, albeit in reverse.

Figure 3B:
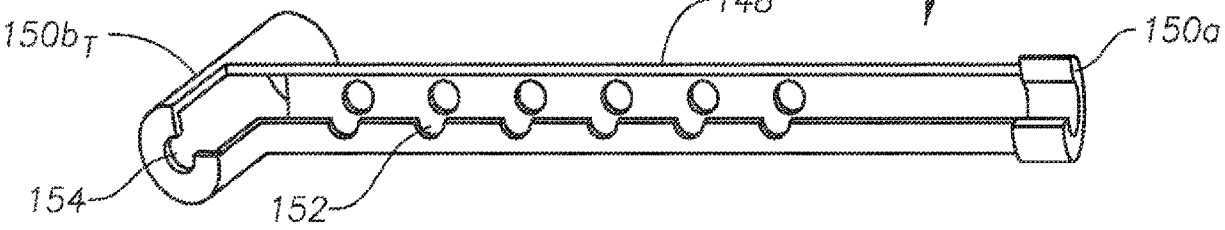
FIG. 3B is a pictorial view of a T-shaped deflector tube, according to certain illustrative embodiments of the present disclosure.

FIG. 3B is a pictorial view of tube 146', according to an alternative embodiment of the present disclosure. Tube 146' is similar to tube 146 of FIG. 3A, as like numerals refer to like elements. However, in FIG. 3B, tube 146' includes a T-shaped second end 150$b_T$ which includes lateral perforations 154 at each lateral end of the "T."

Figure 4:
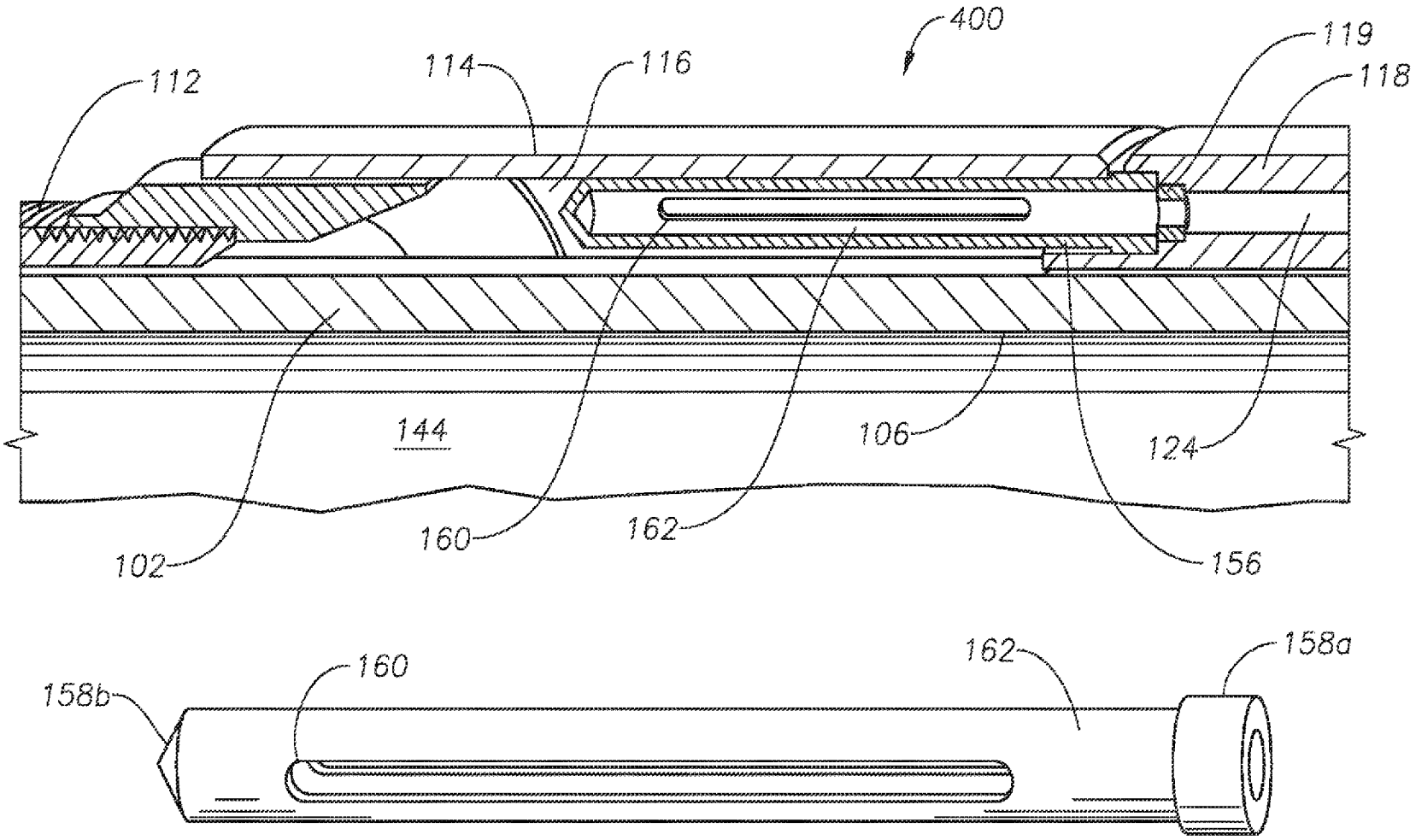
FIG. 4 is a partial view of a flow control system section having slotted tubes, according to certain alternative embodiments of the present disclosure.

FIG. 4 is a partial view of a flow control system section, according to certain alternative embodiments of the present disclosure. Flow control system 400 is similar to flow control system 100, as like numerals refer to like elements. However, in FIG. 4, flow control system 400 includes a slotted tube 156 acting as the flow-induced erosion resistance component. Here, slotted tube 156 includes a first end 158*a* connected to flow control component 119, and a second sealed end 158*b*. Tubular body 162 of slotted tube 156 includes one or more slots 160 positioned thereon. During injection or production operations, slots 160 act in a similar manner as perforations 152, to thereby reduce the fluid energy by altering the direction of the fluid flow, thus reducing and/or eliminating erosion-corrosion along base pipe 102. Although not shown, in an alternate embodiment the slots may be staggered in relation to one another along tubular body 162. For example, on slot may be closer to end 158*b* on one circumferential side of tubular body 16, while another slots is closer to end 158*a* on the opposite circumferential side.

Figure 5:
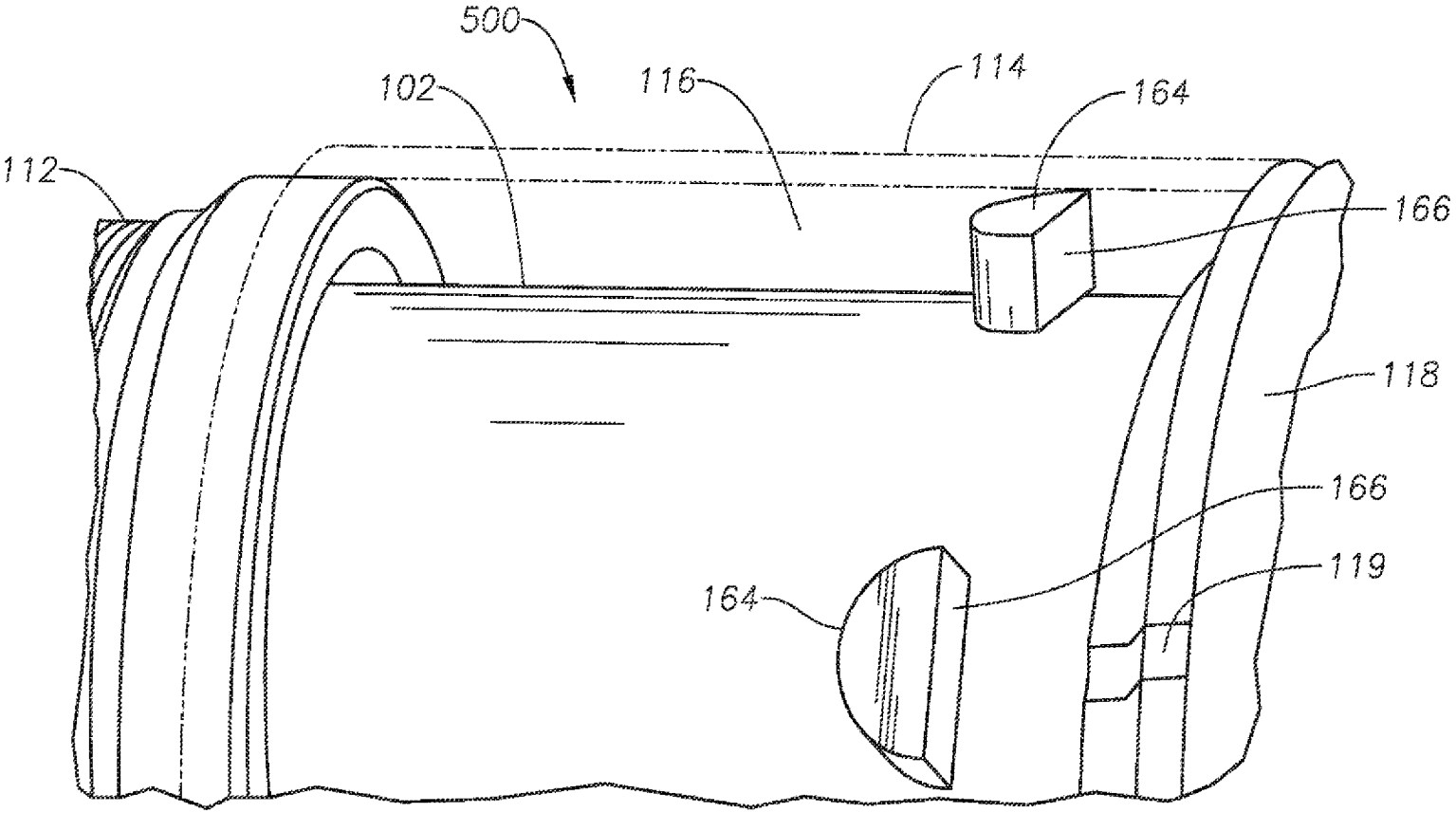
FIG. 5 is a partial view of a flow control system section having flow deflectors with flat faces, according to certain alternative embodiments of the present disclosure.

FIG. 5 is a partial view of a flow control system section, according to certain alternative embodiments of the present disclosure. Flow control system 500 is similar to flow control system 100, as like numerals refer to like elements. However, in FIG. 5, flow control system 500 uses one or more flow deflectors 164 as the flow-induced erosion resistance component. Here, flow deflectors 164 are positioned along annulus 116 as in previous examples and may be attached to base pipe 102, housing 114, may extend from base pipe 102 to housing 114. The attachment may be accomplished by any suitable means. In this example, flow deflectors 164 have a rounded shape with a flat side 166 facing flow control component 119. In certain illustrative embodiments, flat face 166 may be in-line with the nozzle of component 119, while in others it may be staggered in relation to the nozzle.

Nevertheless, during injection operations, the fluid exiting flow control component 119 encounters flat face 166, whereby it is deflected in a direction transverse to the longitudinal axis of base pipe 102. As a result, the energy of the fluid is dissipated once more, to thereby reduce shear stress and erosion-corrosion. In the reverse direction during production, the rounded side of flow deflectors 164 will work in like manner to dissipate the fluid energy, again reducing and/or eliminating erosion-corrosion. Although not shown, in alternative embodiments the sides of flow deflector 164 may also be angular (e.g., "V" shaped).

Figure 6A:
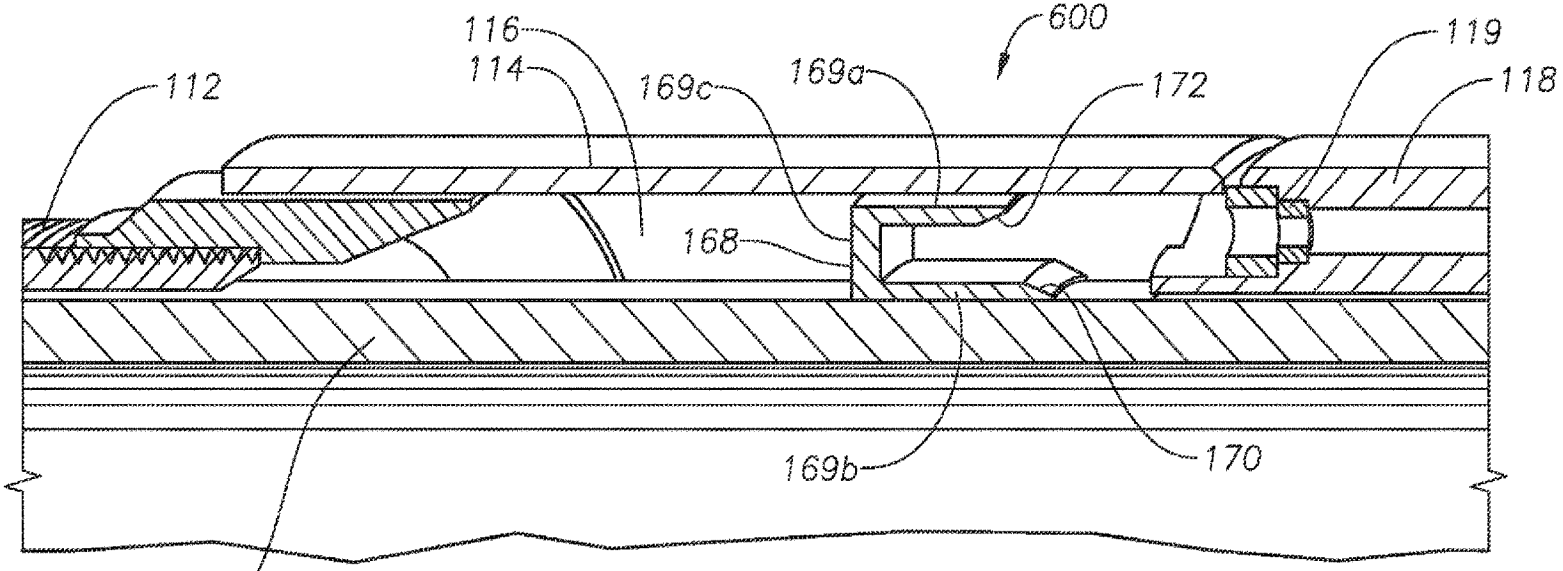
FIG. 6A is a partial view of a flow control system section having U-shaped flow deflectors, according to certain alternative embodiments of the present disclosure.

FIG. 6A is a partial view of a flow control system section, according to certain alternative embodiments of the present disclosure. Flow control system 600 is similar to flow control system 100, as like numerals refer to like elements. However, in FIG. 6A, flow control system 600 includes one or more U-shaped flow deflectors 168 acting as the flow-induced erosion resistance components. In the illustrated example, each flow deflector 168 is positioned around the circumference of base pipe 102 (when more than one are used), thus still allowing fluid flow between each of them. Flow deflectors 168 comprise a top portion 169*a*, bottom portion 169*b*, and a side portion 169*c* extending there between. In certain embodiments, side portion 169*c* is positioned in-line with the nozzle of flow control component 119, while it others it is staggered in relation to the nozzles. Moreover, end 170 of bottom portion 169*b* and end 172 of top portion 169*a* are both angular so as to reduce shear.

During injection operations, as fluid flows out of flow control component 119, it encounters side portion 169*c* where it is deflected into a direction transverse to the axial direction of base pipe 102. In the production scenario, the outer diameter of side portion 169 performs the same function. Accordingly, the energy of the fluid is dissipated, thus reducing shear stress, which in turn reduces and/or eliminates erosion-corrosion.

Figure 6B:
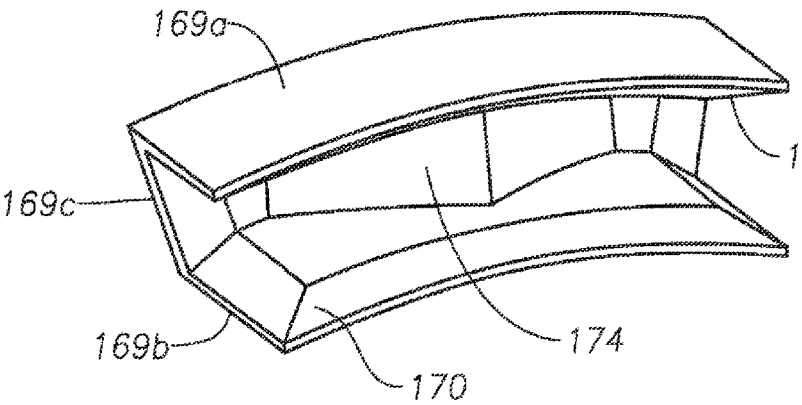
FIG. 6B is an embodiment of a U-shaped flow deflector having an angular profile; according to certain alternative embodiments of the present disclosure.

FIG. 6B is a pictorial view of U-shaped flow deflector 168', according to an alternative embodiment of the present disclosure. Flow deflector 168' is similar to flow deflector 168 of FIG. 6A, as like numerals refer to like elements. However, in FIG. 6B, side portion 169*c* of flow deflector 168' has an angular profile 174 on its inner diameter. The angular shape of profile 174 works to gradually alter the flow direction of injection fluids, thus further reducing the shear stress.

Figure 7A:
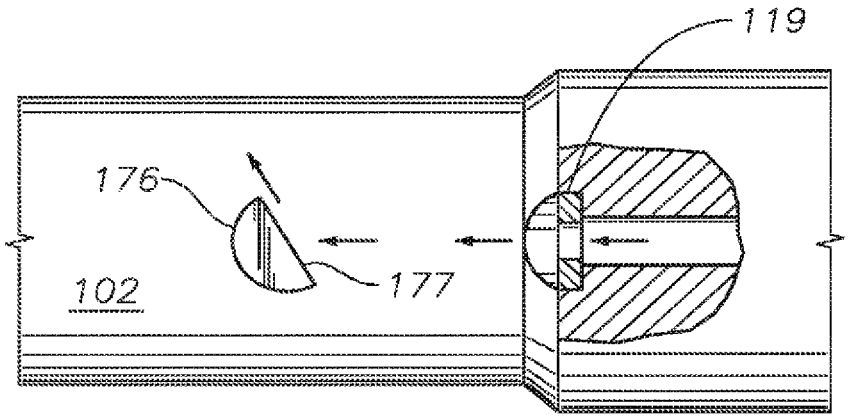
FIGS. 7A-7C are top-down views of various flow-induced erosion resistant components, according to illustrative embodiments of the present disclosure.
Figure 7B:
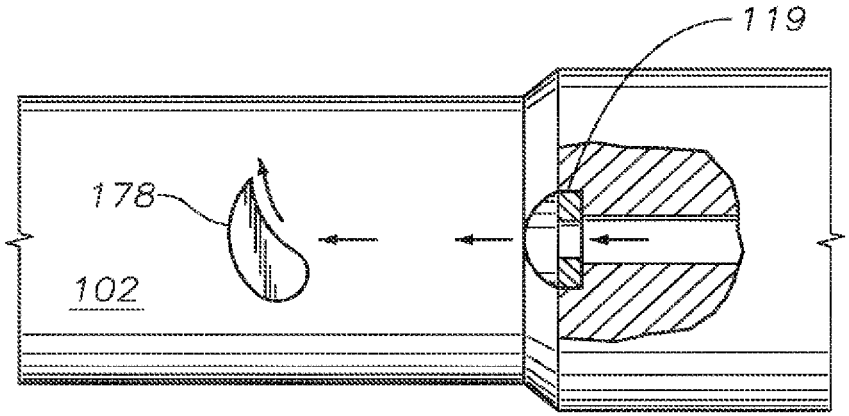
Figure 7C:
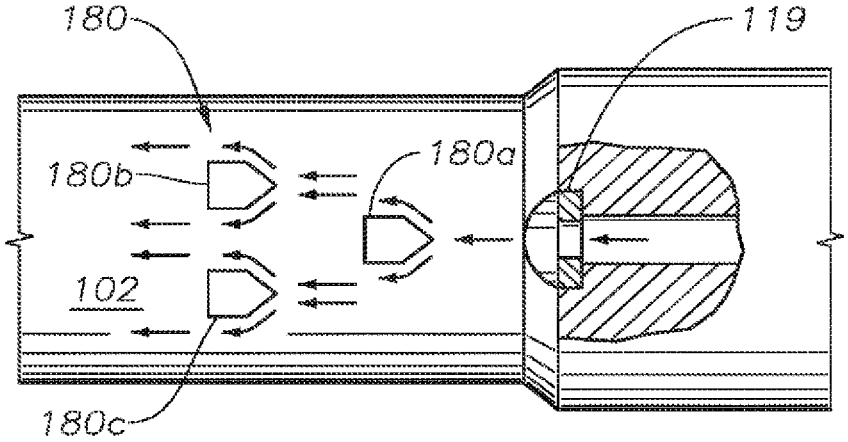

FIGS. 7A-7C are top-down views of various flow-induced erosion resistant components, according to illustrative embodiments of the present disclosure. In FIG. 7A, a flow deflector 176 includes a flat side 177 oriented at an angle oblique (neither parallel nor at a right angle) with respect to the axis of base pipe 102. Thus, during injection operations, for example, as the fluid exits flow control component 119 in a first direction parallel to the axis of base pipe 102, it encounters flat side 177, which then deflects the fluid to a second direction transverse to the first direction (e.g., a circumferential direction around base pipe 102). As such, the energy of the fluid is again dissipated, thus alleviating or eliminating erosion-corrosion of base pipe 102. In FIG. 7B, a helical shaped flow deflector 178 is used to produce the same energy dissipation.

In FIG. 7C, a plurality of flow deflectors are used as the flow-induce erosion resistance component. Here, a first, second and third flow deflector 180*a-c* have a geometric shape such that the end encountering the fluid is V-shaped; however, other shapes may be used in alternate embodiments. Nevertheless, a first flow deflector 180*a* is positioned to receive the fluid flow first in an injection scenario, whereby it is deflected in a transverse direction (to the axis of base pipe 102) as shown. Thereafter, the deflected fluid flow then encounters second and third flow deflectors 180*b-c* to further dissipate its fluid energy. As a result, erosion-corrosion is reduced and/or eliminated.

Figure 8:
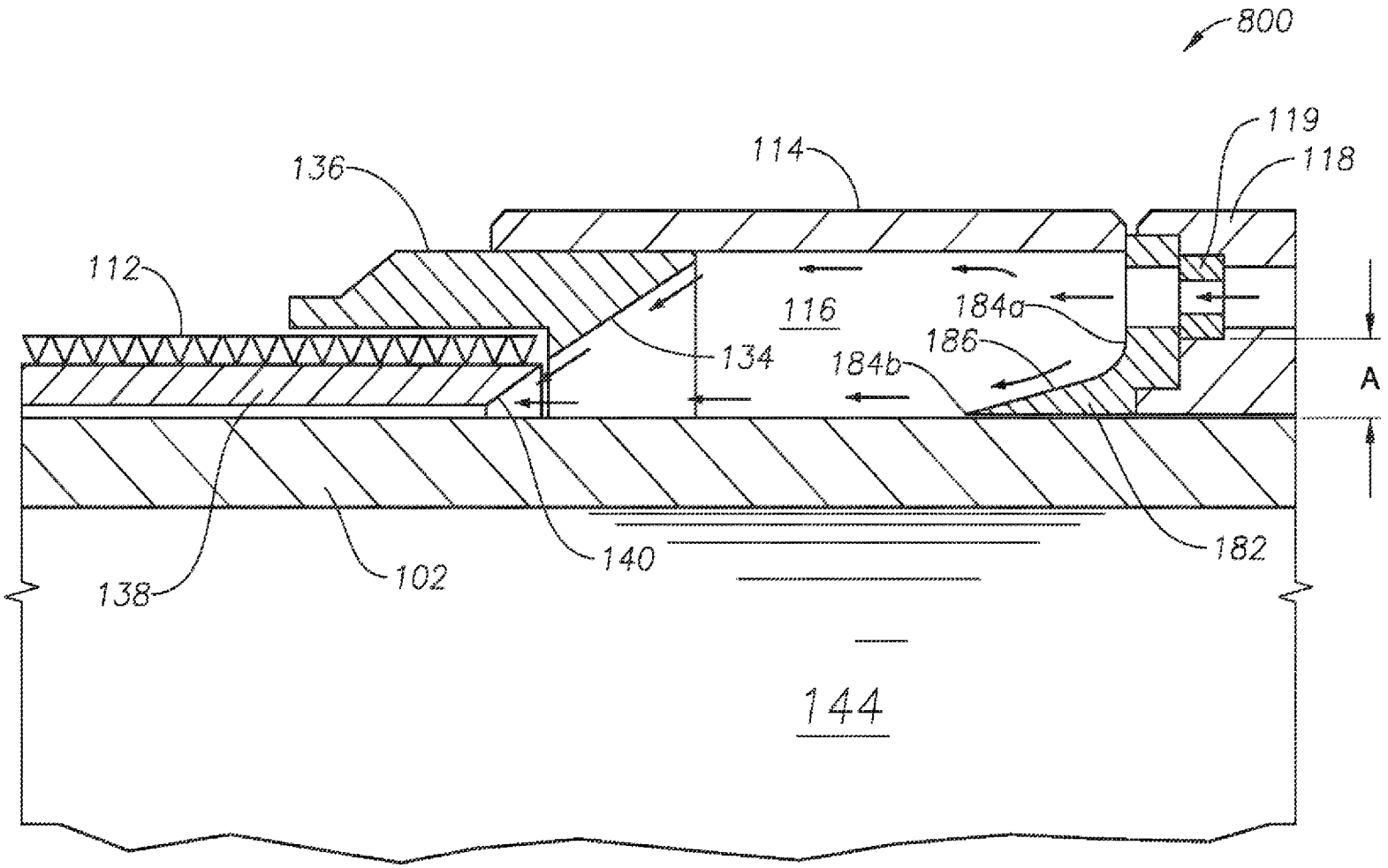
FIG. 8 is a partial view of a flow control system section having a flow guide, according to certain alternative embodiments of the present disclosure.

FIG. 8 is a partial view of a flow control system section, according to certain alternative embodiments of the present disclosure. Flow control system 800 is similar to flow control system 100''', as like numerals refer to like elements. However, in FIG. 8, flow control system 800 includes does not include a sleeve, instead, a flow deflector 182 is used as the flow-induced erosion resistance component. Here, flow guide 182 is positioned along base pipe 102 having its first end 184*a* adjacent the nozzle 119. As show, the thickness A of flow guide 182 is greater at first end 184 than at the opposite end 184*b*, thus forming an angular surface 186. During injection or production, the fluid is allowed to flow across angular surface 186, thus reducing any shear which would otherwise be present as the fluid transitioned between base pipe 102 and flow control component 119.

Embodiments and methods of the present disclosure described herein further relate to any one or more of the following paragraphs:

1. A downhole fluid flow control system, comprising a base pipe with an internal passageway; a filter component positioned around the base pipe; a housing positioned around the base pipe defining a fluid flow path between the filter component and the internal passageway; a flow control component positioned within the fluid flow path operable to control fluid flow therethrough; and a flow-induced erosion resistance component positioned within the fluid flow path between the filter component and flow control component, the flow-induced erosion resistance component being operable to reduce wall shear stress along the base pipe.

2. A system as defined in paragraph 1, wherein the flow-induced erosion resistance component is a flexible or rigid member positioned around the base pipe.

3. A system as defined in paragraphs 1 or 2, wherein the flow-induced erosion resistance component is a sleeve member positioned around the base pipe.

4. A system as defined in any of paragraphs 1-3, wherein the sleeve member extends from the filter component to the flow control component.

5. A system as defined in any of paragraphs 1-4, wherein the sleeve member extends from the flow control component to a position underneath the filter component.

6. A system as defined in any of paragraphs 1-5, wherein the sleeve member extends from the flow control component to a position between the filter component and the flow control component.

7. A system as defined in any of paragraphs 1-6, wherein the sleeve member comprises a plurality of ribs oriented in a direction transverse to an axis of the base pipe.

8. A system as defined in any of paragraphs 1-7, wherein the sleeve member is comprised of an alloy, plastic or rubber material.

9. A system as defined in any of paragraphs 1-8, wherein the flow-induced erosion resistance component is a tube connected to the flow control component, the tube comprising: a tubular body having a first end and a second end opposite the first end, wherein the first end is connected to the flow control component and the second end is sealed to prevent fluid flow therethrough; and a plurality of perforations positioned along the tubular body.

10. A system as defined ins any of paragraphs 1-9, wherein the flow-induced erosion resistance component is a tube connected to the flow control component, the tube comprising: a tubular body having a first end and a T-shaped second end opposite the first end, wherein the first end is connected to the flow control component and the T-shaped second end includes opposing lateral perforations; and a plurality of perforations positioned along the tubular body.

11. A system as defined in any of paragraphs 1-10, wherein the flow-induced erosion resistance component is a tube connected to the flow control component, the tube comprising: a tubular body having a first end and a second end opposite the first end, wherein the first end is connected to the flow control component and the second end is sealed to prevent fluid flow therethrough; and a plurality of slots positioned along the tubular body.

12. A system as defined in any of paragraphs 1-11, wherein the slots are staggered in relation to one another.

13. A system as defined in any of paragraphs 1-12, wherein the flow-induced erosion resistance component is a flow deflector attached to at least one of the housing or base, pipe, the flow deflector being operable to deflect the fluid flow into a direction transverse to an axis of the base pipe.

14. A system as defined, in any of paragraphs 1-13, wherein the flow deflector comprises one or more sides to deflect the fluid flow, the sides being rounded, flat or angular.

15. A system as defined in any of paragraphs 1-14, wherein the flow deflector is positioned in-line with a fluid nozzle of the flow control component.

16. A system as defined in any of paragraphs 1-15, wherein the flow deflector is a U-shaped member comprising a top portion; a bottom portion; and a side portion extending between the top and bottom portion, the side portion being positioned to deflect the fluid flow.

17. A system as defined in any of paragraphs 1-16, wherein the side portion comprises an angular profile.

18. A system as defined in any of paragraphs 1-17, wherein the flow deflector comprises a flat side to deflect the fluid flow, wherein the flat side is oriented at an oblique angle with respect to an axis of the base pipe.

19. A system as defined in any of paragraphs 1-18, wherein the flow-induced erosion resistance component is a plurality of flow deflectors attached to at least one of the housing or base pipe, the flow deflectors comprising: a first flow deflector positioned to deflect the fluid flow into a direction transverse to an axis of the base pipe, thus creating a deflected fluid flow; and a second and third flow deflector positioned to receive the deflected fluid flow to further deflect the deflected fluid flow.

20. A system as defined in any of paragraphs 1-19, wherein the flow-induced erosion resistance component is an angular flow guide positioned along the base pipe, the flow guide comprising: a first end portion positioned adjacent a nozzle of the flow control component; and a second end portion opposite the first end portion, wherein a thickness of the first end portion is greater than a thickness of the second end portion, thereby forming an angular surface extending between the first and second end portions.

21. A system as defined in any of paragraphs 1-20, wherein the filter component comprises a screen assembly positioned along the base pipe; and an interface ring positioned between the screen assembly and the housing, wherein an end of the interface ring nearest the flow control component comprises an angular face oriented toward the flow control component.

22. A system as defined in any of paragraphs 1-21, wherein an end of the screen assembly nearest the flow control component comprises an angular face oriented toward the flow control component.

23. A downhole fluid control method, comprising positioning a fluid flow control system in a wellbore such that a flow-induced erosion resistance component is disposed within a fluid flow path between a formation and an internal passageway of a base pipe, the flow-induced erosion resistance component being disposed between a filter component and a flow control component; allowing fluid to flow through the fluid flow path and protecting a portion of the base pipe along the fluid flow path from wall shear stress using the flow-induced erosion resistance component.

24. A method as defined in paragraph 23, wherein the base pipe portion is protected by preventing fluid from contacting the base pipe portion.

25. A method as defined in paragraphs 23 or 24, wherein the base pipe portion is protected by dissipating flow energy of the fluid flowing through the fluid flow path.

26. A method as defined in any of paragraphs 23-25, wherein the base pipe portion is protected by diverting the fluid flow from a first direction to a second direction different from the first direction.

27. A method as defined in any of paragraphs 23-26, wherein the base pipe portion is protected using a sleeve member positioned around the base pipe.

28. A method as defined in any of paragraphs 23-27, wherein the base pipe portion is protected using a flow deflector positioned along the fluid flow path.

29. A method as defined in any of paragraphs 23-28, wherein the base pipe portion is protected using a flow guide positioned adjacent a nozzle of the flow control component.

30. A method as defined in any of paragraphs 23-29, wherein the base pipe portion is protected using an angular face of the filter component.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the illustrative term "below" can encompass both an orientation of above and below. The apparatus may be otherwise oriented (rotated 90 degrees or at other orientations) and the spatially relative descriptors used herein may likewise be interpreted accordingly.

Although various embodiments and methods have been shown and described, the disclosure is not limited to such embodiments and methods and will be understood to include all modifications and variations as would be apparent to one skilled in the art. For example, one or more of the flow-induced erosion resistance components described herein may be combined for increased erosion-corrosion resistance. Therefore, it should be understood that this disclosure is not intended to be limited to the particular forms disclosed. Rather, the intention is to cover all modifications, equivalents and alternatives falling within the spirit and scope of this disclosure as defined by the appended claims.

What is claimed is:

1. A downhole fluid flow control system, comprising:

a base pipe with an internal passageway;

a filter component positioned around the base pipe;

a housing positioned around the base pipe defining a fluid flow path between the filter component and the internal passageway;

a flow control component positioned within the fluid flow path operable to control fluid flow therethrough; and a flow-induced erosion resistance component positioned within the fluid flow path between the filter component and flow control component, the flow-induced erosion resistance component being operable to reduce wall shear stress along the base pipe;

(A) wherein the flow-induced erosion resistance component is a tube connected to the flow control component, the tube comprising:

(i) a first tubular body having a first end and a second end opposite the first end, wherein the first end is connected to the flow control component and the second end is sealed to prevent fluid flow therethrough; and a plurality of perforations positioned along the tubular body;

(ii) a second tubular body having a first end and a T-shaped second end opposite the first end, wherein the first end is connected to the flow control component and the T-shaped second end includes opposing lateral perforations; and a plurality of perforations positioned along the tubular body; or (iii) a third tubular body having a first end and a second end opposite the first end, wherein the first end is connected to the flow control component and the second end is sealed to prevent fluid flow therethrough; and a plurality of slots positioned along the tubular body;

(B) wherein the flow-induced erosion resistance component is a flow deflector attached to at least one of the housing or base pipe, the flow deflector being operable to deflect the fluid flow into a direction transverse to an axis of the base pipe; and wherein the flow deflector comprises a flat side to deflect the fluid flow, wherein the flat side is oriented at an oblique angle with respect to an axis of the base pipe; or (C) wherein the flow-induced erosion resistance component is an angular flow guide positioned along the base pipe, the flow guide comprising:

a first end portion positioned adjacent a nozzle of the flow control component; and a second end portion opposite the first end portion, wherein a thickness of the first end portion is greater than a thickness of the second end portion, thereby forming an angular surface extending between the first and second end portions.

2. The system as defined in claim 1, wherein the flow-induced erosion resistance component comprises the first tubular body.

3. The system as defined in claim 1, wherein the flow-induced erosion resistance component comprises the second tubular body.

4. The system as defined in claim 1, wherein the flow-induced erosion resistance component comprises the third tubular body.

5. The system as defined in claim 1, wherein the tube comprises the third tubular body; and wherein the slots are staggered in relation to one another.

6. The system as defined in claim 1, wherein the flow-induced erosion resistance component is the flow deflector.

7. The system as defined in claim 1, wherein the flow-induced erosion resistance component is the angular flow guide.

8. A downhole fluid flow control system, comprising:

a base pipe with an internal passageway;

a filter component positioned around the base pipe;

a housing positioned around the base pipe defining a fluid flow path between the filter component and the internal passageway;

a flow control component positioned within the fluid flow path operable to control fluid flow therethrough; and a flow-induced erosion resistance component positioned within the fluid flow path between the filter component and flow control component, the flow-induced erosion resistance component being operable to reduce wall shear stress along the base pipe;

wherein the filter component comprises:

a screen assembly positioned along the base pipe; and an interface ring positioned between the screen assembly and the housing, wherein an end of the interface ring nearest the flow control component comprises an angular face oriented toward the flow control component.

9. The system as defined in claim 8, wherein the flow-induced erosion resistance component is:

a flexible or rigid member positioned around the base pipe; or a sleeve member positioned around the base pipe.

10. The system as defined in claim 9, wherein the sleeve member:

extends from the filter component to the flow control component;

extends from the flow control component to a position underneath the filter component; or extends from the flow control component to a position between the filter component and the flow control component.

11. The system as defined in claim 9, wherein:

the sleeve member comprises a plurality of ribs oriented in a direction transverse to an axis of the base pipe; or the sleeve member is comprised of an alloy, plastic or rubber material.

12. The system as defined in claim 8;

wherein the flow-induced erosion resistance component is a flow deflector attached to at least one of the housing or base pipe, the flow deflector being operable to deflect the fluid flow into a direction transverse to an axis of the base pipe.

13. The system as defined in claim 12, wherein:

the flow deflector comprises one or more sides to deflect the fluid flow, the sides being rounded, flat or angular;

the flow deflector is positioned in-line with a fluid nozzle of the flow control component; or the flow deflector is a U-shaped member comprising a top portion, a bottom portion, and a side portion extending between the top and bottom portion, the side portion being positioned to deflect the fluid flow.

14. The system as defined in claim 13, wherein the side portion comprises an angular profile.

15. The system as defined in claim 8, wherein the flow-induced erosion resistance component is a plurality of flow deflectors attached to at least one of the housing or base pipe, the flow deflectors comprising:

a first flow deflector positioned to deflect the fluid flow into a direction transverse to an axis of the base pipe, thus creating a deflected fluid flow; and a second and third flow deflector positioned to receive the deflected fluid flow to further deflect the deflected fluid flow.

16. The system as defined in claim 8, wherein an end of the screen assembly nearest the flow control component comprises an angular face oriented toward the flow control component.

17. A downhole fluid control method, comprising:

positioning a fluid flow control system in a wellbore such that a flow-induced erosion resistance component is disposed within a fluid flow path between a formation and an internal passageway of a base pipe, the flow-induced erosion resistance component being disposed between a filter component and a flow control component;

allowing fluid to flow through the fluid flow path; and protecting a portion of the base pipe along the fluid flow path from wall shear stress using the flow-induced erosion resistance component;

(A) wherein the flow-induced erosion resistance component is a tube connected to the flow control component, the tube comprising:

(i) a first tubular body having a first end and a second end opposite the first end, wherein the first end is connected to the flow control component and the second end is sealed to prevent fluid flow therethrough; and a plurality of perforations positioned along the tubular body;

(ii) a second tubular body having a first end and a T-shaped second end opposite the first end, wherein the first end is connected to the flow control component and the T-shaped second end includes opposing lateral perforations; and a plurality of perforations positioned along the tubular body; or (iii) a third tubular body having a first end and a second end opposite the first end, wherein the first end is connected to the flow control component and the second end is sealed to prevent fluid flow therethrough; and a plurality of slots positioned along the tubular body;

(B) wherein the flow-induced erosion resistance component is a flow deflector attached to at least one of the housing or base pipe, the flow deflector being operable to deflect the fluid flow into a direction transverse to an axis of the base pipe; and wherein the flow deflector comprises a flat side to deflect the fluid flow, wherein the flat side is oriented at an oblique angle with respect to an axis of the base pipe; or (C) wherein the flow-induced erosion resistance component is an angular flow guide positioned along the base pipe, the flow guide comprising:

a first end portion positioned adjacent a nozzle of the flow control component; and a second end portion opposite the first end portion, wherein a thickness of the first end portion is greater than a thickness of the second end portion, thereby forming an angular surface extending between the first and second end portions.

18. The method as defined in claim 17, wherein:

the base pipe portion is protected by preventing fluid from contacting the base pipe portion;

the base pipe portion is protected by dissipating flow energy of the fluid flowing through the fluid flow path;

the base pipe portion is protected by diverting the fluid flow from a first direction to a second direction different from the first direction; or the base pipe portion is protected using a sleeve member positioned around the base pipe.

19. The method as defined in claim 17, wherein:

the base pipe portion is protected using a flow deflector positioned along the fluid flow path;

the base pipe portion is protected using a flow guide positioned adjacent a nozzle of the flow control component; or the base pipe portion is protected using an angular face of the filter component.

20. A downhole fluid control method, comprising:

positioning a fluid flow control system in a wellbore such that a flow-induced erosion resistance component is disposed within a fluid flow path between a formation and an internal passageway of a base pipe, the flow-induced erosion resistance component being disposed between a filter component and a flow control component;

allowing fluid to flow through the fluid flow path; and protecting a portion of the base pipe along the fluid flow path from wall shear stress using the flow-induced erosion resistance component;

wherein the filter component comprises:

a screen assembly positioned along the base pipe; and an interface ring positioned between the screen assembly and the housing, wherein an end of the interface ring nearest the flow control component comprises an angular face oriented toward the flow control component.

21. The method as defined in claim 20, wherein:

the base pipe portion is protected by preventing fluid from contacting the base pipe portion;

the base pipe portion is protected by dissipating flow energy of the fluid flowing through the fluid flow path;

the base pipe portion is protected by diverting the fluid flow from a first direction to a second direction different from the first direction; or the base pipe portion is protected using a sleeve member positioned around the base pipe.

22. The method as defined in claim 20, wherein:

the base pipe portion is protected using a flow deflector positioned along the fluid flow path;

the base pipe portion is protected using a flow guide positioned adjacent a nozzle of the flow control component; or the base pipe portion is protected using an angular face of the filter component.

* * * * *